US009243495B2

(12) United States Patent
Jeffrey et al.

(10) Patent No.: US 9,243,495 B2
(45) Date of Patent: Jan. 26, 2016

(54) TOOL AND METHOD FOR INITIATING HYDRAULIC FRACTURING

(75) Inventors: Robert Graham Jeffrey, Upper Ferntree Gully (AU); Anthony Charles Coleman, Wheelers Hill (AU)

(73) Assignee: COMMONWEALTH SCIENTIFIC AND INDUSTRIAL RESEARCH ORGANISATION, Campbell (AU)

( * ) Notice: Subject to any disclaimer, the term of this patent is extended or adjusted under 35 U.S.C. 154(b) by 495 days.

(21) Appl. No.: 13/700,281

(22) PCT Filed: May 26, 2011

(86) PCT No.: PCT/AU2011/000624

§ 371 (c)(1),
(2), (4) Date: Jan. 16, 2013

(87) PCT Pub. No.: WO2011/146983

PCT Pub. Date: Dec. 1, 2011

(65) Prior Publication Data

US 2013/0140872 A1 Jun. 6, 2013

(30) Foreign Application Priority Data

May 27, 2010 (AU) ..... 2010902329

(51) Int. Cl.
*E21B 33/127* (2006.01)
*E21C 37/12* (2006.01)
(Continued)

(52) U.S. Cl.
CPC ..... *E21C 37/12* (2013.01); *E21B 33/127* (2013.01); *E21B 33/1243* (2013.01); *E21B 43/26* (2013.01); *E21C 41/16* (2013.01)

(58) Field of Classification Search
CPC combination set(s) only.
See application file for complete search history.

(56) References Cited

U.S. PATENT DOCUMENTS 2,851,109 A * 9/1958 Spearow ..... 166/177.5
2,943,684 A * 7/1960 Smith ..... 166/100
(Continued)

FOREIGN PATENT DOCUMENTS

EP 0 522 628 B1 10/1996
GB 2 384 019 B 10/2003
WO WO 2008/139132 A1 11/2008

OTHER PUBLICATIONS

International Search Report, mailed Aug. 15, 2011 in connection with PCT International Application No. PCT/AU2011/000624, filed May 26, 2011.
(Continued)

*Primary Examiner* — John Kreck
(74) *Attorney, Agent, or Firm* — John P. White; Cooper & Dunham LLP

(57) ABSTRACT

A tool for use in initiating a hydraulic fracture in a bore hole comprises an elongate cylindrical bore hole packer structure (11) having an inner longitudinal passage (12), a mid-portion (13) provided with ports (14) extending outwardly from passage (12) to the exterior periphery of the packer structure (11) and expandable circumferential well portions (15A) surrounding the inner longitudinal passage (12) to each side of the mid-portion (13). In use of the tool the circumferential wall portions (15A) can be expanded by injection of hydraulic fracturing fluid into passage 12) and exit of the injected fluid through the ports (14) to produce a pressure difference between the inside of the packer structure and the outside of the packer structure as the fluid passes through the ports (14) such that the hydraulic fluid exiting the packer structure can initiate a fracture. The packer structure (11) is disposed between a pair of tool end pieces (16) one of which provides a fluid inlet for injection of hydraulic fluid into one end of passage (12) and the other of which closes the other end of passage (12) against outflow of hydraulic fluid therefrom.

18 Claims, 5 Drawing Sheets

(51) Int. Cl.

| | |
|---|---|
| ***E21B 33/124*** | (2006.01) |
| ***E21B 43/26*** | (2006.01) |
| ***E21C 41/16*** | (2006.01) |

(56) References Cited

U.S. PATENT DOCUMENTS 3,181,608 A * 5/1965 Palmer ..... 166/250.02
5,472,049 A 12/1995 Chaffee et al.
6,296,054 B1 * 10/2001 Kunz et al. ..... 166/187

OTHER PUBLICATIONS

Written Opinion of the International Searching Authority, mailed Aug. 15, 2011, in connection with PCT International Application No. PCT/AU2011/000624, filed May 26, 2011.
International Preliminary Report on Patentability, issued Nov. 27, 2012, in connection with PCT International Application No. PCT/AU2011/000624, filed May 26, 2011.

* cited by examiner

TOOL AND METHOD FOR INITIATING HYDRAULIC FRACTURING

CROSS-REFERENCE TO RELATED APPLICATIONS

This application is a §371 national stage of PCT International Application No. PCT/AU2011/000624, filed May 26, 2011, claiming priority of Australian Patent Application No. 2010902329, filed May 27, 2010, the contents of each of which are hereby incorporated by reference in their entirety.

FIELD OF THE INVENTION

This invention relates to hydraulic fracturing of ground formations. It has particular, but not exclusive application to hydraulic fracturing of ore bodies mined by caving, especially block caving and panel caving.

BACKGROUND OF THE INVENTION

Caving is a mining technique in which an ore body or rock mass is undercut under a sufficient area that material caves into the undercut area from which it can be progressively withdrawn, for example, through drawbells into extraction tunnels beneath the undercut. The rate at which caving action progresses is dependent on the rate at which the broken material is extracted.

In ore bodies that are marginally caveable it is possible that instead of continuously caving a stable arch can form if the rock mass is strong enough and it then becomes difficult to promote further caving. U.S. Pat. No. 6,123,394 discloses a method for overcoming problems associated with caving stronger rock by utilising the technique of hydraulic fracturing. By that technique an ore body can be conditioned to promote caving by drilling bore holes into the ore body and initiating fractures at locations within the bore holes by the installation of inflatable packers and pumping hydraulic fluid into spaces between the packers. The ore body may be hydraulically fractured before caving is initiated or after caving has been initiated if necessary to maintain or promote further caving.

Various inflatable straddle tools have been developed for placement within bore holes to initiate hydraulic fracturing. These tools generally have separate spaced packers held apart by rigid steel straddles with hydraulic fluid passages for the supply of hydraulic fracturing fluid to firstly inflate the two separate packers and then to direct fluid to the space between the packers to initiate hydraulic fracturing. Some tools have valving to control and divert the flow of hydraulic fluid between the packers and the space for fracturing. Alternatively, some tools have an external inflation line that is used to inflate the packers separately from the injection fluid. The present invention enables construction of a tool which is of simpler construction and which can be more rapidly deployed and retrieved than conventional straddle packet tools. The invention may also enable initiation of fractures at closer spacing along a bore hole than is possible with conventional straddle packer tools.

SUMMARY OF THE INVENTION

In one embodiment of the invention, a tool for use in initiating a hydraulic fracture in a bore hole may comprise:

an elongate cylindrical bore hole packer structure having an inner longitudinal passage, a mid-portion provided with one or more ports extending outwardly from said passage to the exterior periphery of the packer structure and expandable circumferential wall portions surrounding the inner longitudinal passage to each side of the mid-portion whereby in use of the tool the circumferential wall portions can be expanded by injection of hydraulic fracturing fluid into said passage and exit of the injected fluid through the port or ports to produce a pressure difference between the inside of the packer structure and the outside of the packer structure as the fluid passes through the port or ports such that the fluid exiting the packer structure can initiate a fracture.

The packer structure may be disposed between a pair of tool end pieces one of which provides a fluid inlet for injection of hydraulic fluid into one end of said passage and the other of which closes the other end of the passage against outflow of hydraulic fluid therefrom.

The end pieces may be made of steel and the fluid inlet may be screw threaded.

The circumferential expandable wall portions of the packer structure may be comprised of rubber reinforced with circumferentially spaced longitudinal reinforcement elements.

Each outlet port may be provided by a metal or ceramic or tungsten carbide insert set into the mid-portion of the packer structure.

In an alternative construction each outlet port may provide a flow aperture which expands and contracts in response of pressure within the inner passage.

The expandable wall portions may be portions of a single expandable circumferential wall extending through the mid-portion of the packer structure. In that case, the inner passage may be lined at the mid-portion of the packer structure with a tubular metal liner formed in segments to allow outward expansion thereof with the expandable wall in the vicinity of the port or ports.

In a modified construction, the mid-portion of the packer structure may be comprised of a rigid metal element and the expandable wall portions may be formed by separate components fitted to that element.

In another embodiment of the invention, a method of initiating a hydraulic fracture at a location along a bore hole may comprise positioning at said location a tool as described above and injecting hydraulic fracturing fluid into the inner passage of the tool to cause expansion of the expandable wall of the tool into sealing engagement with the bore hole and outflow of fluid from the passage through the port or ports of the tool to initiate a hydraulic fracture at said location.

There may also be provided a method of initiating a series of hydraulic fractures at spaced locations along a bore hole, comprising moving a tool as described above along the bore hole so as to position the tool successively at each of said locations and injecting hydraulic fracturing fluid into the inner passage of the tool when the tool is so located at each location to cause expansion of the expandable wall of the tool into sealing engagement with the bore hole at each of said locations and outflow of hydraulic fracturing fluid through the port or ports of the tool to initiate a fracture at each of said locations along the bore hole.

BRIEF DESCRIPTION OF THE DRAWINGS

In order that the invention may be more fully explained, one particular fracturing packer tool and its method of operation will be described in detail with reference to the accompanying drawings in which.

Figure 1:
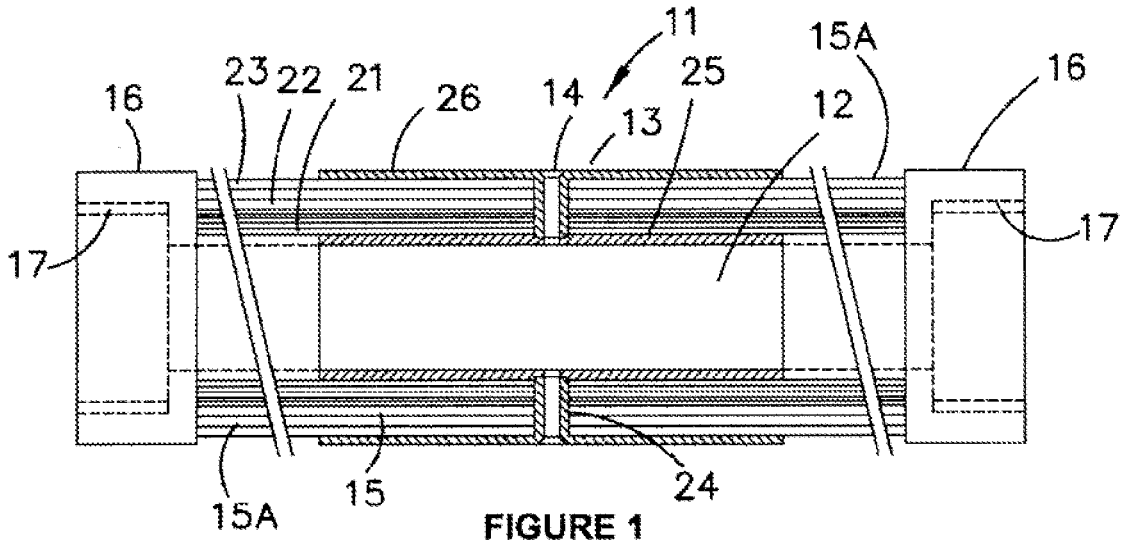
FIG. 1 is a longitudinal cross section through one form of tool constructed in accordance with the invention.
Figure 2:
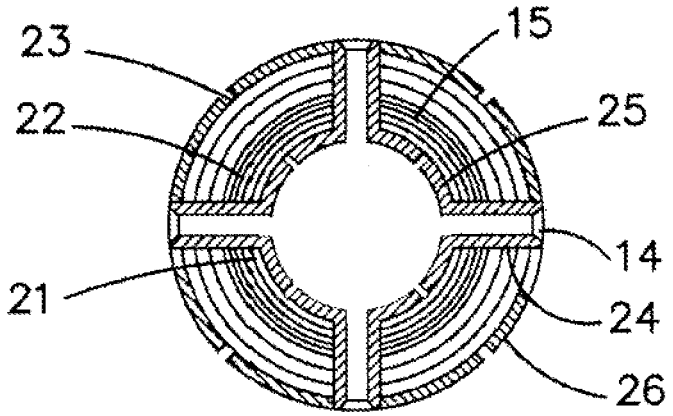
FIG. 2 is a transverse cross section on the line 2-2 in FIG. 1.

The fracturing packer tool illustrated in FIGS. 1 to 6 comprises an elongate cylindrical bore hole packer structure noted generally as 11 having an longitudinal passage 12 and a mid-portion 13 which is provided with radial ports 14 extending outwardly from passage 14 to the exterior periphery of packer structure 11. Four ports 14 are shown in FIG. 2 but the number of ports can vary and there could for example be as many as eight ports spaced circumferentially around the packer structure. Packer structure 11 has an expandable circumferential wall 15 disposed between a pair of steel tool end pieces 16 provided with internal screw threads 17.

In use of the tool, fracturing fluid is injected into the internal passage 12 of the packer structure through one of the tool end pieces 16 and the other tool end piece 16 is closed against outflow of hydraulic fluid so that the fluid must exit the packer structure through the ports 14. The pressure drop across the ports then serves to inflate the packer structure by expansion of the expandable wall 15. Specifically, the two expandable wall portions 15A to each side of the mid-portion 13 containing the ports 14 are expanded to prevent fluid from leaking past the inflatable packer structure on either side of the ports so that a fracture is formed at the ports and extended into a surrounding rock.

The expandable wall 15 of packer structure 11 is formed from an internal rubber sealing tube 21, wire and rubber reinforcement layers 22 and outer rubber layers 23. The ports are formed by removable metal inserts 24 which can be constructed from various materials to suit the fluid system being injected. The expandable wall 15 is fitted in the vicinity of ports 14 with an internal liner sleeve 25 and an outer port sleeve 26. Sleeves 25 and 26 may be segmented to allow outward expansion thereof with the expandable wall 15 about the ports 14.

Figure 3:
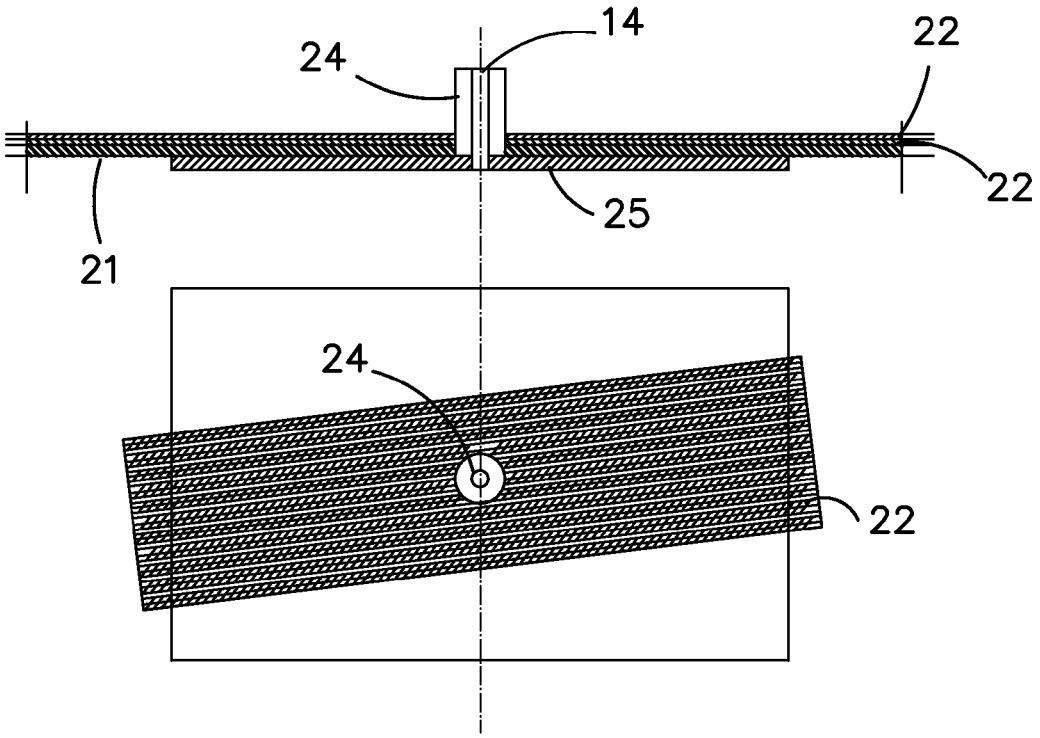
FIGS. 3 and 4 illustrates construction details of the tool shown in FIGS. 1 and 2.
Figure 4:
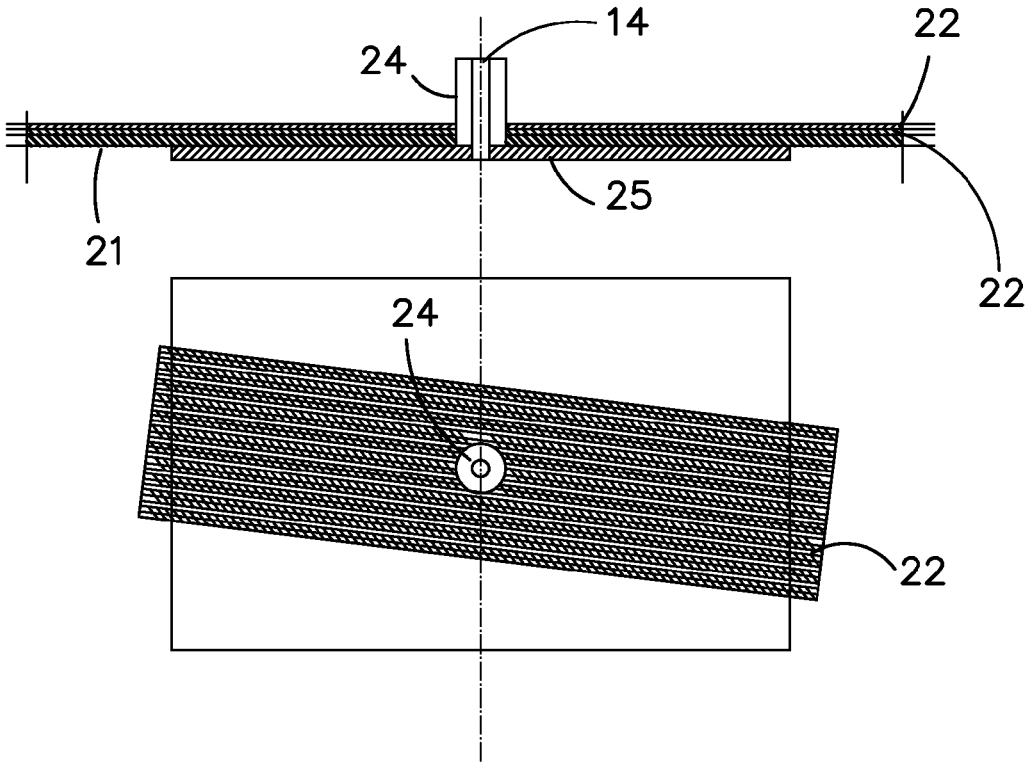

FIG. 3 shows how the rubber and rubber-steel layers 22 are built up during construction by laying strips lengthwise along the packer structure and around each injection port 14. One rubber-wire layer is shown passing across the port area with a bias to the wire direction so that wires extend in an open helical formation along the wall. Successive reinforcement layers are laid with opposite bias as indicated in FIG. 4 showing the bias of a layer preceding or succeeding the layer shown in FIG. 3.

Figure 5:
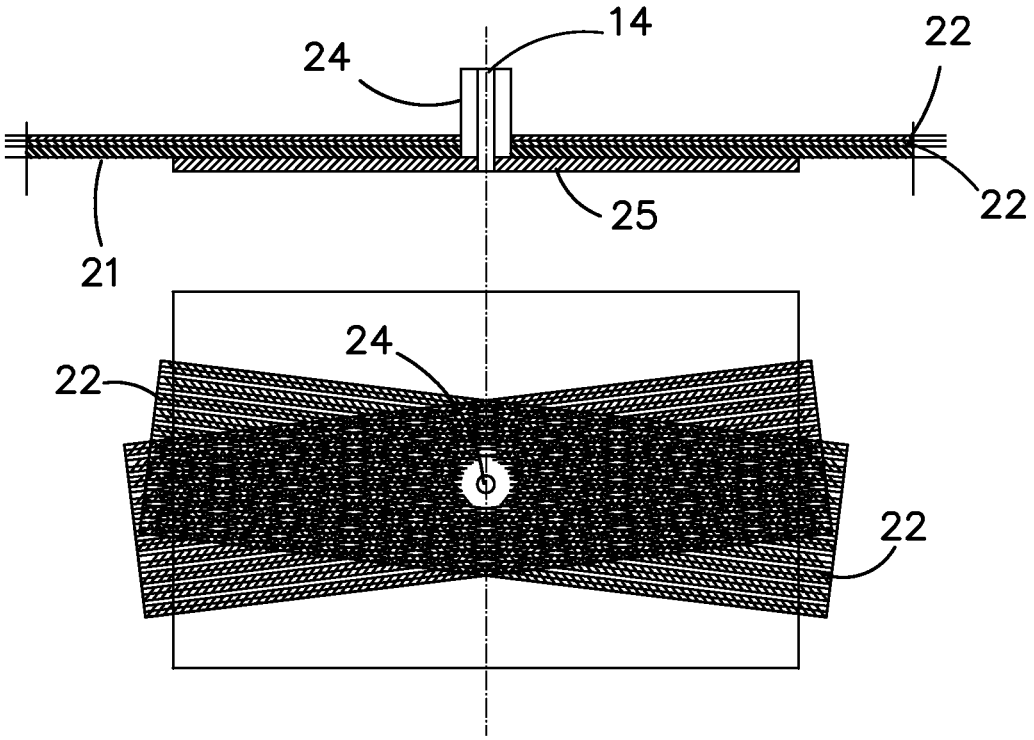
FIGS. 5 and 6 show two variations in arranging wall reinforcement elements around a port in the tool.
Figure 6:
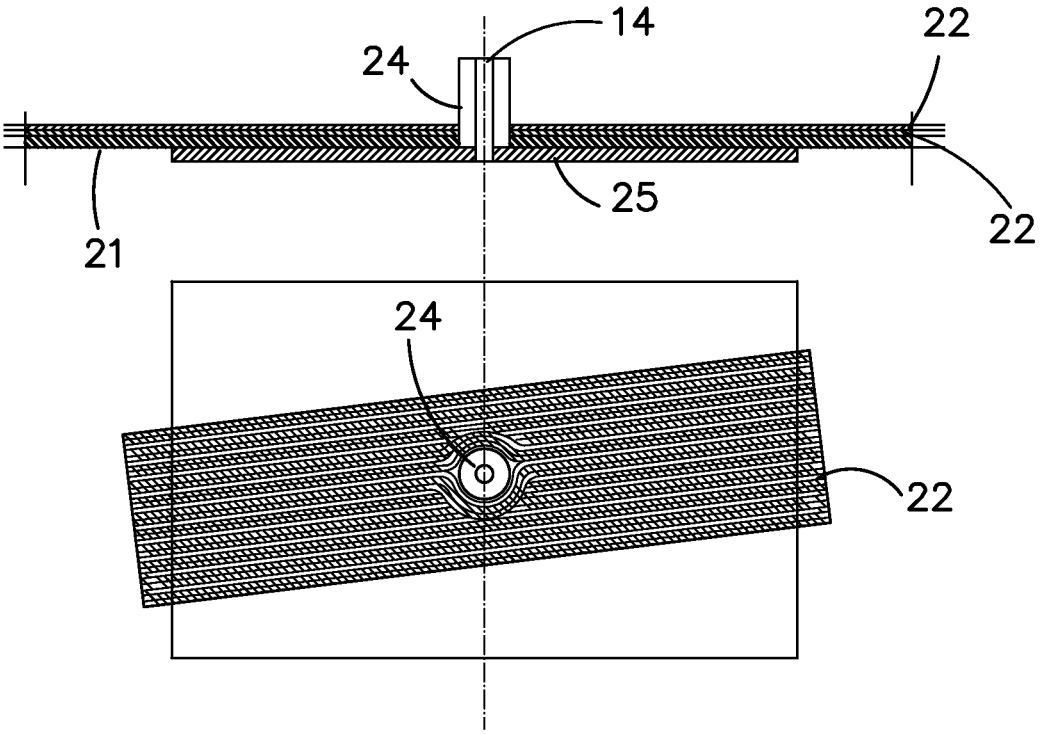

FIG. 5 illustrates an assembly of packer strips around an injection port showing two rubber-wire strips with alternating bias applied during assembly. Each strip may have a hole drilled or punched through it at each location of an injection port and this hole can be slipped over the port insert during the assembly process. FIG. 6 illustrates an alternative construction in which the rubber-wire strips can be expanded around the port insert rather than by drilling through each strip.

The tool illustrated in FIGS. 1 to 6 is particularly suitable for use as a short straddle tool for generation of hydraulic fractures at close spacing along a bore hole. Typically the tool may be of the order of 1200 mm length and the spacing between fractures can be as short as 625 mm without the inflatable packer wall being set over a previous fracture zone. For a typical flow rate of 400 liters per minute the ports 14 may produce a 3 MPa pressure difference which inflates the packer walls to form seals to either side of the ports.

The end piece 16 of the tool which is not used as the inlet for injection of hydraulic fluid may be closed off against both outflow and inflow of fluid but in some applications where high pressure fluid from previous fracturing operations may be encountered in the bore hole, that end piece may be fitted with an inlet bleed or check valve to relieve pressure from the bore hole back into the tool but seal when a higher pressure is applied inside the packer.

Figure 7:
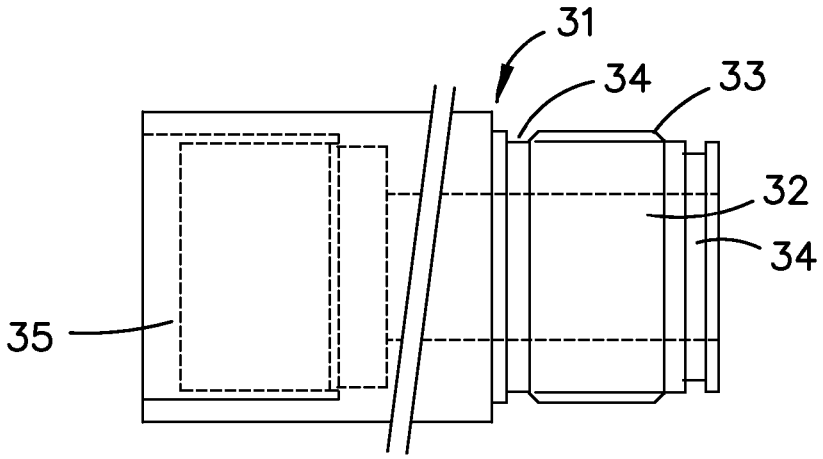
FIG. 7 illustrates an extension piece to allow an increase of the straddle section length of the tool illustrated in the preceding Figures.

FIG. 7 illustrates an extension sub 31 for use with a short straddle tool of the kind illustrated in FIGS. 1 to 6. Sub 31 comprises a head piece 32 screw threaded at 33 to screw into one of the end pieces 16 of the short straddle tool and with a pair of grooves 34 for an O-ring to seal the connection. Headpiece 32 is connected to an inflatable packer section of any required length extending through to an internally screwed threaded packer end 35. Extension subs allow increases to the straddle section length so that more of the rock is subjected to pressure between the packers.

Figure 8:
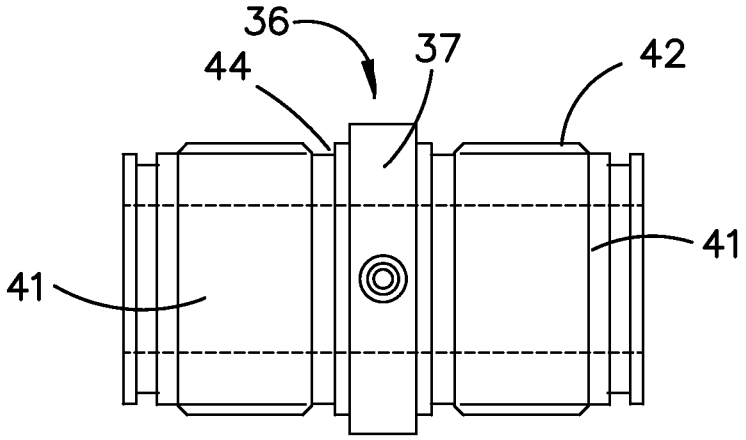
FIG. 8 illustrates a central straddle piece for use with individual removable and replaceable packers to be attached to either end of the central straddle piece to form a alternative tool construction in accordance with the invention.
Figure 9:
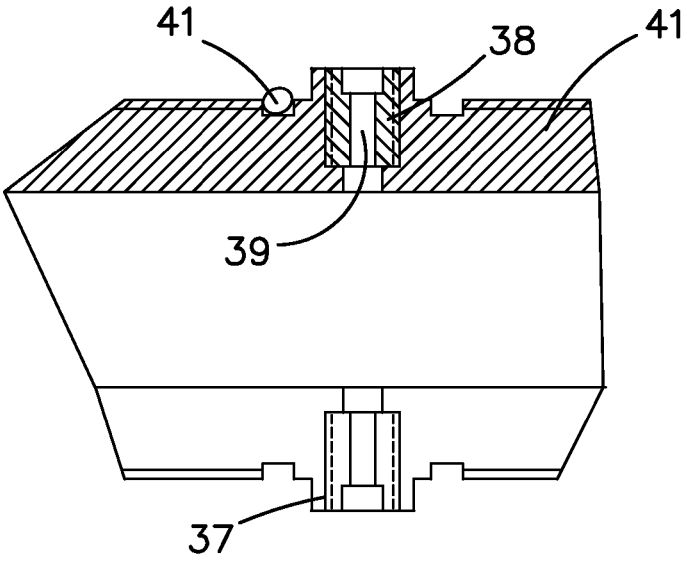
FIG. 9 is a longitudinal cross section through part of the central straddle piece illustrated in FIG. 8.

FIGS. 8 and 9 illustrate how an alternative kind of packer fracturing tool may be assembled from a central straddle section 36 housing the ports and individual removable and replaceable packers that are attached to either end of the central straddle section. The central straddle section 36 has a mid-part 37 containing threaded inserts 38 forming the ports 39 and a pair of end sections or plugs 41 provided with screw threads 42 to screw into the ends 43 of individual removable and replaceable packers, O-rings 44 being provided to seal the connections.

In the tool construction assembled in the manner shown in FIGS. 8 and 9, the inflatable circumferential wall portions of the tools to each side of the mid portion of the packer structure are formed separately by the individual removable and replaceable packers that are attached to either end of the central straddle section. As in the previous construction, inflation of the packers is achieved as a result of the pressure drop that occurs as the fluid passes through the ports in the mid-part of the tool. The port inserts can be constructed of various materials depending on the purpose of the straddle tool and the types of fluids and particulates that will be pumped during fracturing operations. For example, if clear fluid is to be used, port inserts made of steel or stainless steel could be used, but if proppants are to be used then port inserts made of tungsten carbide ceramics or other wear resistant material can be used. With this configuration, the overall straddle section length is equal to the length of the central port section plus the lengths of the two threaded packer ends that are attached to this port section. A typical configuration for a HQ sized packer assembly would then result in a straddle section with a minimum length of approximately 420 mm to 450 mm long. If desired, the straddle section can be made longer by inserting a spacing sub.

Instead of being provided with fixed diameter circular orifice ports, straddle tools constructed in accordance with the invention may be provided with ports that open and close as pressure increases and decreases within the inner passage. The ports then act as pressure regulating ports helping to maintain a more constant pressure inside the packer tool and allowing the packers to inflate and seal over a wide range of injection rates. In particular the packer can inflate and seal the straddle zone at a lower rate and will maintain the seal without developing too high an internal pressure up to injection rates of more than 600 L/min.

Figure 10:
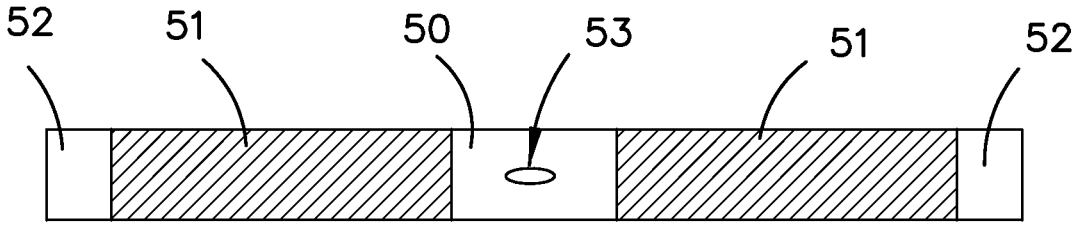
FIG. 10 illustrates a straddle tool that is provided with ports that can open and close as pressure within the tool increases and decreases.
Figure 11:
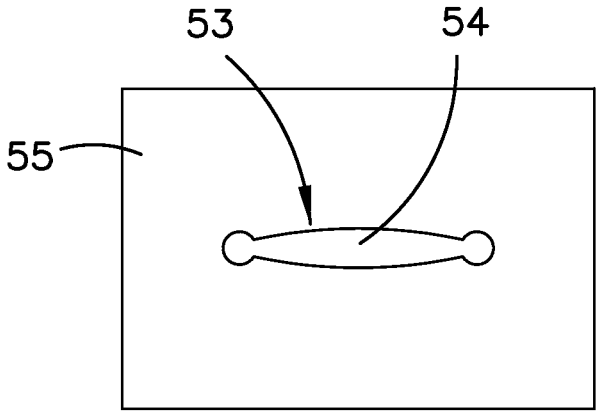
FIG. 11 is a detail of one of the ports in the tool of FIG. 10.
Figure 12:
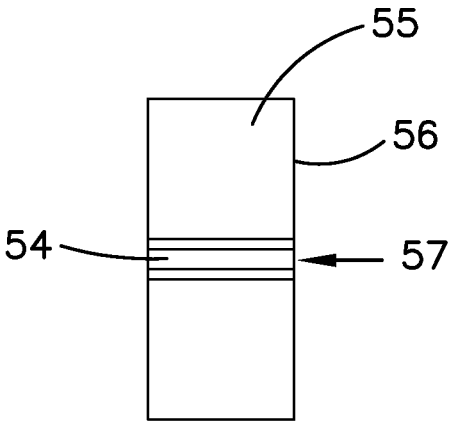
FIG. 12 is a cross-section through the port in FIG. 11.

One method of achieving pressure regulating ports is illustrated in FIGS. 10 to 12 which show diagrammatically a packer tool comprising a mid-portion 50 and two expandable portions 51 disposed to each side of the mid-portion 50 and between tool end pieces 52. The tool mid-portion 50 has ports 53 each providing a flow aperture 54 that expands and contracts in response to increase and decrease of pressure within the inner passage of the tool. Aperture 54 is an elongate slot formed in surrounding material 55 that can flex to cause the slot to expand under the influence of pressure acting on the inside face 56 of material surrounding the aperture 54 as fluid passes through the aperture in the direction of arrow 57. The port aperture opens as the flow and pressure through it increase which helps maintain a more constant pressure inside the tool and allows the packer portions 51 to inflate and seal over a wide range of injection rates. The ends of slot 54 are formed to circular shapes 58 to reduce stress concentrations there. Pressure inside the slot causes it to increase in aperture slightly and the additional aperture allows more fluid to pass through it at only a slightly higher pressure. The length of the slot and the enclosing material stiffness can be designed to produce a desired pressure vs. aperture behaviour. The material 55 surrounding the slot may be part of the peripheral wall of the tool mid-portion 50 or it could be material of an insert set into the mid-portion in which case the mid-portion could be formed as a rigid metal element for use with separate expandable components in the manner illustrated in FIGS. 7 to 9. Other porting arrangements that allow the port to open as the pressure and flow rate increases can be used. For example, the port may comprise of a spring and valve arrangement such that the spring acts to close the valve and the pressure acts to open it.

The invention claimed is:

1. A tool for use in initiating a hydraulic fracture in a bore hole, comprising an elongate cylindrical bore hole packer structure having an inner longitudinal passage, a mid-portion provided with one or more ports extending outwardly from said passage to the exterior periphery of the packer structure and expandable circumferential wall portions surrounding the inner longitudinal passage to each side of the mid-portion whereby in use of the tool the circumferential wall portions can be expanded by injection of hydraulic fracturing fluid into said passage and exit of the injected fluid through the port or ports to produce a pressure difference between the inside of the packer structure and the outside of the packer structure as the fluid passes through the port or ports such that the fluid exiting the packer structure can initiate a fracture, and wherein the port or each port is provided by a metal insert set into the mid-portion of the packer structure.

2. A tool according to claim 1, wherein the packer structure is disposed between a pair of tool end pieces one of which provides a fluid inlet for injection of hydraulic fracturing fluid into one end of said passage and the other of which closes the other end of the passage against outflow of hydraulic fluid therefrom.

3. A tool according to claim 2, wherein the end pieces are made of steel and the fluid inlet is screw threaded.

4. A tool according to claim 1, wherein the circumferential expandable wall portions of the packer structure are comprised of rubber.

5. A tool according to claim 4, wherein the circumferential expandable wall portions of the packer structure are reinforced with circumferentially spaced longitudinal reinforcement elements.

6. A tool according to claim 5, wherein the reinforcement elements extend helically along the expandable wall portions.

7. A tool according to claim 1, wherein the port or each port provides a flow aperture that expands and contracts in response to increase and decrease of pressure within said inner passage.

8. A tool according to claim 7, wherein the flow aperture is an elongate slot formed in material that can flex to cause the expansion and contraction of the aperture.

9. A tool according to claim 8, wherein the ends of the slot are formed to circular shapes to reduce stress concentrations.

10. A tool according to claim 1, wherein the expandable wall portions are portions of a single expandable circumferential wall extending through the mid-portion of the packer structure.

11. A tool according to claim 10, wherein the inner passage is lined at the mid-portion of the packer structure with a tubular metal liner formed in segments to allow outward expansion thereof with the expandable walls in the vicinity of the port or ports.

12. A tool according to claim 10, wherein expandable wall is fitted with an external peripheral sleeve at the mid-portion of the packer structure formed in segments to allow outward expansion thereof with the expandable wall in the vicinity of the port or ports.

13. A tool according to claim 1, wherein the mid-portion of the packer structure is comprised of a rigid metal element and the expandable circumferential wall portions are formed by separate components fitted to that element.

14. A method of initiating a hydraulic fracture at a location along a bore hole, comprising positioning at said location a tool according to claim 1 and injecting hydraulic fracturing fluid into the inner passage of the tool to cause expansion of the expandable wall of the tool into sealing engagement with the bore hole and outflow of fluid from the passage through the port or ports of the tool to initiate a hydraulic fracture at said location.

15. A method of initiating a series of hydraulic fractures at spaced locations along a bore hole, comprising moving a tool according to claim 1 along the bore hole so as to position the tool successively at each of said locations and injecting hydraulic fracturing fluid into the inner passage of the tool when the tool is so located at each location to cause expansion of the expandable wall of the tool into sealing engagement with the bore hole at each of said locations and outflow of fluid through the port or ports of the tool to initiate a fracture at each of said locations along the bore hole.

16. A tool according to claim 2, wherein the circumferential expandable wall portions of the packer structure are comprised of rubber.

17. A tool according to claim 3, wherein the circumferential expandable wall portions of the packer structure are comprised of rubber.

18. A tool according to claim 11, wherein expandable wall is fitted with an external peripheral sleeve at the mid-portion of the packer structure formed in segments to allow outward expansion thereof with the expandable wall in the vicinity of the port or ports.

* * * * *